US006736046B2

(12) United States Patent
Elliott et al.

(10) Patent No.: US 6,736,046 B2
(45) Date of Patent: May 18, 2004

(54) PILOT CONTROL VALVE UTILIZING MULTIPLE OFFSET SLIDE VALVES

(75) Inventors: Andrew C. Elliott, Covington, LA (US); Ray A. Guccione, Sr., Marrero, LA (US)

(73) Assignee: Checkpoint Fluidic Systems International, Ltd., Marrero, LA (US)

( * ) Notice: Subject to any disclaimer, the term of this patent is extended or adjusted under 35 U.S.C. 154(b) by 32 days.

(21) Appl. No.: 10/274,708

(22) Filed: Oct. 21, 2002

(65) Prior Publication Data

US 2004/0074383 A1 Apr. 22, 2004

(51) Int. Cl.[7] ..... F01L 25/02
(52) U.S. Cl. ..... 91/308; 137/625.63; 91/350
(58) Field of Search ..... 91/304, 317, 313, 91/350; 137/625.63; 417/399, 403

(56) References Cited

U.S. PATENT DOCUMENTS

| | | | |
|---|---|---|---|
| 3,374,713 A | | 3/1968 | Broughton |
| 3,800,665 A | | 4/1974 | Von Ruden |
| 4,062,639 A | | 12/1977 | Conlec |
| 4,104,008 A | | 8/1978 | Hoffmann et al. |
| 4,280,396 A | | 7/1981 | Zeuner et al. |
| 4,593,712 A | | 6/1986 | Quartana |
| 4,776,773 A | | 10/1988 | Quartana |
| 5,002,469 A | | 3/1991 | Murata et al. |
| 5,468,127 A | * | 11/1995 | Elliott et al. ..... 91/308 |
| 6,183,217 B1 | | 2/2001 | Elliott et al. |

FOREIGN PATENT DOCUMENTS

| | | |
|---|---|---|
| CA | 2168152 A | 1/1996 |
| CA | 2310525 | 6/2000 |
| DE | 2626954 A1 | 1/1978 |
| DE | 2660470 C2 | 6/1984 |
| DE | 19603434 A | 1/1996 |
| EP | 1059425 | 12/2000 |
| FR | 2355180 A1 | 1/1978 |
| GB | 211837 A | 9/1924 |
| GB | 440689 A | 1/1936 |

* cited by examiner

*Primary Examiner*—Thomas E. Lazo
(74) *Attorney, Agent, or Firm*—Jones Walker

(57) ABSTRACT

A pilot control valve for controlling a reciprocating pump has a valve member shiftable within a valve body between a first or "downstroke" position and a second or "upstroke" position. In its first and second positions, the valve member positions slide valves to allow communication of control fluid to move the piston to a second and first position, respectively. When the piston reaches its second position a poppet disposed in a rod attached to the piston allows control fluid acting on the valve member to depressurize. Pressurized control fluid then acts on the valve member to move to its second position. When the piston returns to its first position, the poppet allows pressurized control fluid acting on the upper surface of the piston to act on the valve member to move the valve member back to its first position and repeat the process.

34 Claims, 6 Drawing Sheets

PILOT CONTROL VALVE UTILIZING MULTIPLE OFFSET SLIDE VALVES

BACKGROUND OF THE INVENTION

1. Field of the Invention

The present invention relates to a pilot control valve that achieves a continuous and consistent pumping rate for a reciprocating pump. More particularly, the pilot control valve of the present invention relates to a pilot control valve that controls the flow of control fluid to a piston, valve or the like to drive a reciprocating device such as a chemical or glycol injection pump. The pilot control valve of the present invention controls such flow through a pneumatic valve mechanism having a movable valve member and a plurality of slide valves slideably engaging the movable valve member. By selectively communicating and venting pressurized control fluid through a plurality of control fluid conduits, the pilot control valve of the present invention provides for increased pressurization and venting of the control fluid acting on the piston to increase the pumping speed of the reciprocating device.

2. General Background

There are various prior art devices known for controlling reciprocating pumps. Many prior art devices use a mechanical control mechanism to drive the piston of the reciprocating pump, but these mechanisms have been unreliable either because they require a number of failure- and/or wear-prone components or because they can stall or vary in stroke frequency in response to varying operating conditions frequently encountered in practical usage. One pilot control valve invention using pneumatic valve control and improving on these prior art devices is the pilot control valve invention disclosed in U.S. Pat. No. 6,183,217 B1, entitled "Pilot Control Valve for Controlling a Reciprocating Pump" which issued on Feb. 6, 2001.

The pilot control valve disclosed in U.S. Pat. No. 6,183,217 B1 changes the directional flow of control fluid to a piston coupled to the pilot control valve to drive a reciprocating device. More specifically, the pilot control valve of U.S. Pat. No. 6,183,217 B1 includes a valve member shiftable within a valve body between a first or "downstroke" position and a second or "upstroke" position. When in its first position, the valve member allows communication of pressurized control fluid supplied to the valve body to the lower surface of the piston to initiate movement of the piston from its first or "downstroke" position to its second or "upstroke" position. The pressurized control fluid is communicated to the lower surface of the piston through a first pressurized fluid conduit extending along the length of the valve body outside of the valve body. As the piston reaches its second position, a vent in a rod attached to the piston allows control fluid acting on the valve member retaining the valve member in its first position to depressurize and vent from the valve body. The pressurized control fluid is vented from the valve body through a fluid exhaust conduit extending out of the valve body. As such control fluid is depressurized and vented, pressurized control fluid acts on the valve member to initiate movement of the valve member from its first position to its second position. As the valve member moves from its first position to its second position, a slide valve portion of the valve member advances with the valve member from a first position to a second position. In its second position, the valve member through the positioning of the slide valve portion precludes communication of control fluid to the lower surface of the piston and allows communication of pressurized control fluid to the upper surface of the piston causing the piston to return to its first position. The pressurized control fluid is communicated to the upper surface of the piston through a second pressurized fluid conduit extending along the length of the valve body but within the valve body. As the piston returns to its first position, the vent in the piston rod allows the pressurized control fluid acting on the upper surface of the piston to act on the valve member to move the valve member back to its first position. As the valve member returns to its first position, the slide valve portion of the valve member also returns to its first position. In its first position, the valve member through the positioning of the slide valve portion precludes communication of the control fluid to the upper surface of the piston and allows the pressurized control fluid to vent through a fluid exhaust conduit. The valve member through the positioning of the slide valve portion also allows communication of the control fluid through the first pressurized fluid conduit to the lower surface of the piston and the process is repeated over and over. The duration of each cycle is varied by adjusting a backpressure valve that varies the rate that the control fluid acting on the piston is depressurized and vented from the valve body during each cycle. This process is repeated over and over to achieve a consistent pumping rate for the reciprocating device that uses only pneumatic valve control.

The pilot control valve of U.S. Pat. No. 6,183,217 B1 overcame the prior art devices by improving reliability by controlling the communication of control fluid to a piston included with a reciprocating device using pneumatic valve control rather than a mechanical control mechanism. Although the pilot control valve disclosed in U.S. Pat. No. 6,183,217 B1 has significant advantages, there is still a need for a pilot control valve that delivers a greater volume of control fluid at an increased pressure to drive reciprocating devices at increased stroke rates. Furthermore, there is a need for a pilot control valve that can be tuned to prevent stalling under differing pressure, viscosity, and/or compressibility properties of the control fluid. Finally, there is a need to reduce the operating impact stresses on the pilot control valve by more smoothly transitioning the valve member from its first position through its second position. Such improved performance would need to be achieved without sacrificing reliability and by still providing for the complete control of the piston in a pneumatic manner.

SUMMARY OF THE INVENTION

The pilot control valve of the present invention represents an improvement over the pilot control valve of U.S. Pat. No. 6,183,217 B1 for most reciprocating device applications because it increases the stroke rate of the reciprocating device, it prevents stalling, it increases the tolerance of the reciprocating device to varying properties of the control fluid, it reduces the likelihood of freezing of the control fluid, and it reduces the impact stresses on the valve member, but still relies solely on pneumatic valve control. These improvements are realized with an actual increase in reliability.

Similar to the pilot control valve of U.S. Pat. No. 6,183,217 B1, the pilot control valve of the present invention is positioned above the piston included with the reciprocating device to provide linear, reciprocating force using compressible or non-compressible pressurized control fluid to drive the piston. The pilot control valve of the present invention controls the communication of the control fluid to the piston using pneumatic valve control.

More specifically, the pilot control valve of the present invention includes a valve member shiftable within a valve body between a first or "downstroke" position and a second or "upstroke" position. When in its first position, a pair of slide valves slideably engaging the valve member allow communication of control fluid supplied to the valve body to the lower surface of the piston to initiate movement of the piston from its first position to its second position. Simultaneously, the slide valves allow the control fluid acting on the upper surface of the piston to vent through exhaust ports located in the valve body. The pressurized control fluid is communicated to the lower surface of the piston through a first pair of pressurized fluid conduits extending along the length of the valve body. The pilot control valve of U.S. Pat. No. 6,183,217 B1 delivered pressurized control fluid to the upper surface of the piston through a single fluid conduit. By using a pair of pressurized fluid conduits, two distinct advantages are gained. First, an offset of variable magnitude can be introduced between the two slide valves, which enables the pilot control valve to operate without stalling under varying properties of the control fluid and reduces impact stress on the valve member. Second, the volume of control fluid delivered to the piston is doubled, increasing the maximum pumping speed significantly and preventing freezing of wet control fluid (such as humid compressed air or natural gas) which is prevalent with the single fluid conduit and port design disclosed in U.S. Pat. No. 6,183,217 B1 and with competitive designs. While this second advantage could also be achieved by increasing the size of the single port fluid conduit and port, increasing the fluid conduit and port size would increase the size of the entire mechanism whereas no size increase is required to add a second slide valve and fluid conduit.

As the piston reaches its second position, a poppet in a piston rod attached to the piston is in a "closed," or first position, allowing control fluid acting on the valve member retaining the valve member in its first position to depressurize and vent from the valve body through a hole located just above the poppet. The pressurized control fluid is vented from the valve body through a fluid exhaust conduit extending out of the valve body. As such control fluid is depressurized and vented, pressurized control fluid acts on the valve member to initiate movement of the valve member from its first position to its second position. As the valve member moves to its second position, the valve member advances the slide valves upward from a first position to a second position.

In its second position, the valve member through the positioning of the slide valves precludes communication of control fluid to the lower surface of the piston and allows communication of pressurized control fluid to the upper surface of the piston causing the piston to return to its first position. The slide valves simultaneously allow communication of the control fluid acting on the lower surface of the piston to exhaust through ports located in the valve body. The two ports providing the exhaust of the control fluid together provide for a lower pressure drop of the control fluid as it vents from the lower surface of the piston, decreasing the temperature drop, and thereby reducing the risk of freezing. Pressurized control fluid is communicated to the upper surface of the piston using a second pair of pressurized fluid conduits rather than a single fluid conduit as described in U.S. Pat. No. 6,183,217 B1. Both pressurized fluid conduits extend downward through the valve body to the piston to deliver control fluid to act on the upper surface of the piston. In this way, an increased volume of control fluid acts on the piston to increase its speed.

As the piston returns to its first position, the lower hole in the piston rod becomes exposed to the pressurized control fluid acting on the upper surface of the piston. The poppet in the piston rod moves to its "open" or second position as the pressurized control fluid acting on the upper surface of the piston acts on the valve member to move the valve member back to its first position. As the valve member returns to its first position, the valve member advances the slide valves downward from a second position to a first position. In its first position, the valve member through the positioning of the slide valves precludes communication of the control fluid to the upper surface of the piston and simultaneously allows the pressurized control fluid to vent through a fluid exhaust conduit. The valve member through the positioning of the slide valves also allows communication of the control fluid through the first pair of pressurized fluid conduits to the lower surface of the piston and the cycle is repeated. At this moment, and prior to the initial upward motion of the piston, the control fluid holding the valve member in its first position may under various pressure, viscosity, and/or compressibility properties of the control fluid begin to flow in reverse along the same path it followed when pressurizing the valve member to move the valve member to its first position. This tendency is especially severe in the case that the control fluid is either a mixture of liquid and gas phases, or when the pressure of the control fluid is especially high. In the invention as described in U.S. Pat. No. 6,183,217 B1, this flow would have the effect of causing the valve member to move back toward its second position, possibly causing a stall condition. In the present invention, this backward flow causes the poppet to move to its "closed" or first position, blocking any backward flow and preventing movement of the valve member from the first position until the piston begins to move back towards its second position and the lower hole in the piston rod is once again isolated from the control fluid acting on the piston. The duration of each cycle can be varied by adjusting a backpressure valve that varies the rate that the control fluid acting on the piston is depressurized and vented from the valve body during each cycle. This process is repeated over and over to achieve a consistent pumping rate for the reciprocating device that uses only pneumatic valve control.

As noted, the pilot control valve of the present invention increases the stroke rate of the reciprocating device by increasing the volume of the control fluid delivered to the piston surfaces during each stroke. This increase in volume is achieved using the dual pair of pressurized fluid conduits to communicate fluid from the valve body to the piston chambers. The first pair of pressurized fluid conduits communicates control fluid from the valve body to the lower surface of this piston to urge the piston to its second position. The second pair of pressurized fluid conduits communicates control fluid from the valve body to the upper surface of the piston to urge the piston from its second position back to its first position. The pilot control valve of the present invention delivers such pressurized control fluid and achieves such increased stroke rate with improved reliability.

The pilot control valve of the present invention also eliminates the risk of stalling of the valve member during each stroke cycle because the pair of slide valves can be offset relative to one another. The magnitude of the offset depends upon the properties of the control fluid. This offset allows movement of one slide valve to be initiated at a different position of the valve member than the movement of the second slide valve. As the valve member moves upward, the lower edge of the first valve slide is engaged by the valve member just prior to the lower edge of second slide valve being engaged by the valve member. The invention as described in U.S. Pat. No. 6,183,217 B1 was susceptible to stalling when the single slide valve could simultaneously block both the upper and lower ports, preventing movement of the piston to either the first or second position. The present invention eliminates this possibility by guaranteeing that at least one port will remain partially open at all times, thus guaranteeing movement of the piston to either the first or the second positions. The offset of the present invention has the further effect of rounding the response of the valve member at the points where the valve member changes its direction of movement rather than having abrupt changes in movement, reducing impact stress on the valve member and thus extending its life dramatically. The invention as described in U.S. Pat. No. 6,183,217 B1 created the need for the valve member to be made of a highly impact-resistant material, increasing its cost, while the present invention eliminates that cost. The magnitude of the offset can be as low as zero (no offset) depending on the particular properties of the control fluid.

These and other features and advantages of the present invention will become apparent from the following detailed description, the accompanying drawings and the appended claims.

BRIEF DESCRIPTION OF THE DRAWINGS

For a further understanding of the features and advantages of the present invention, reference should be made to the following detailed description taken in conjunction with the accompanying drawings in which like parts are given like reference numerals and wherein.

DETAILED DESCRIPTION OF THE PREFERRED EMBODIMENT

Figure 1:
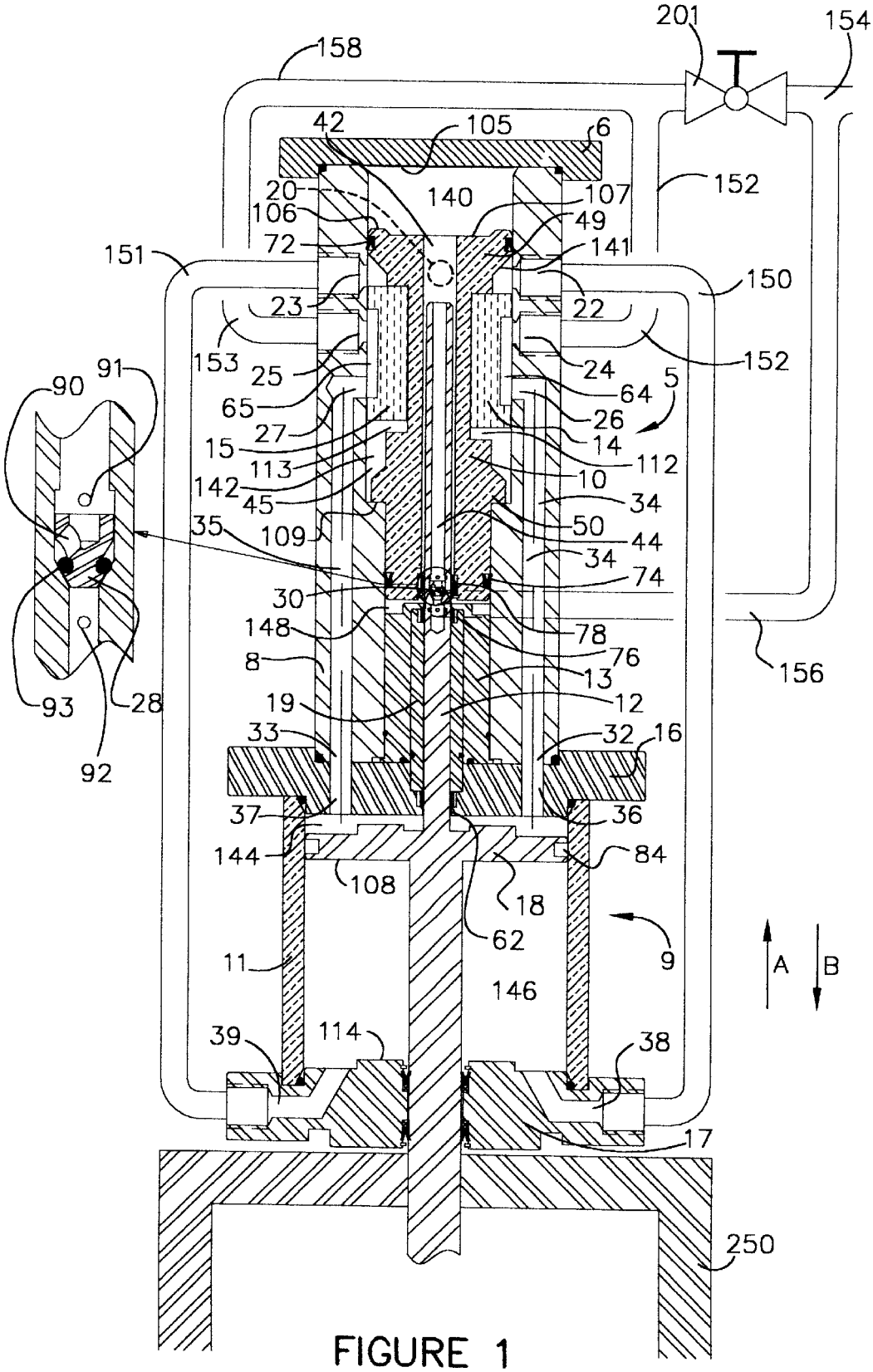
FIG. 1 is a vertical cross-sectional view of the present invention with the valve member of the present invention in its first position, the piston in its second position, and the poppet in its first position.
Figure 1A:
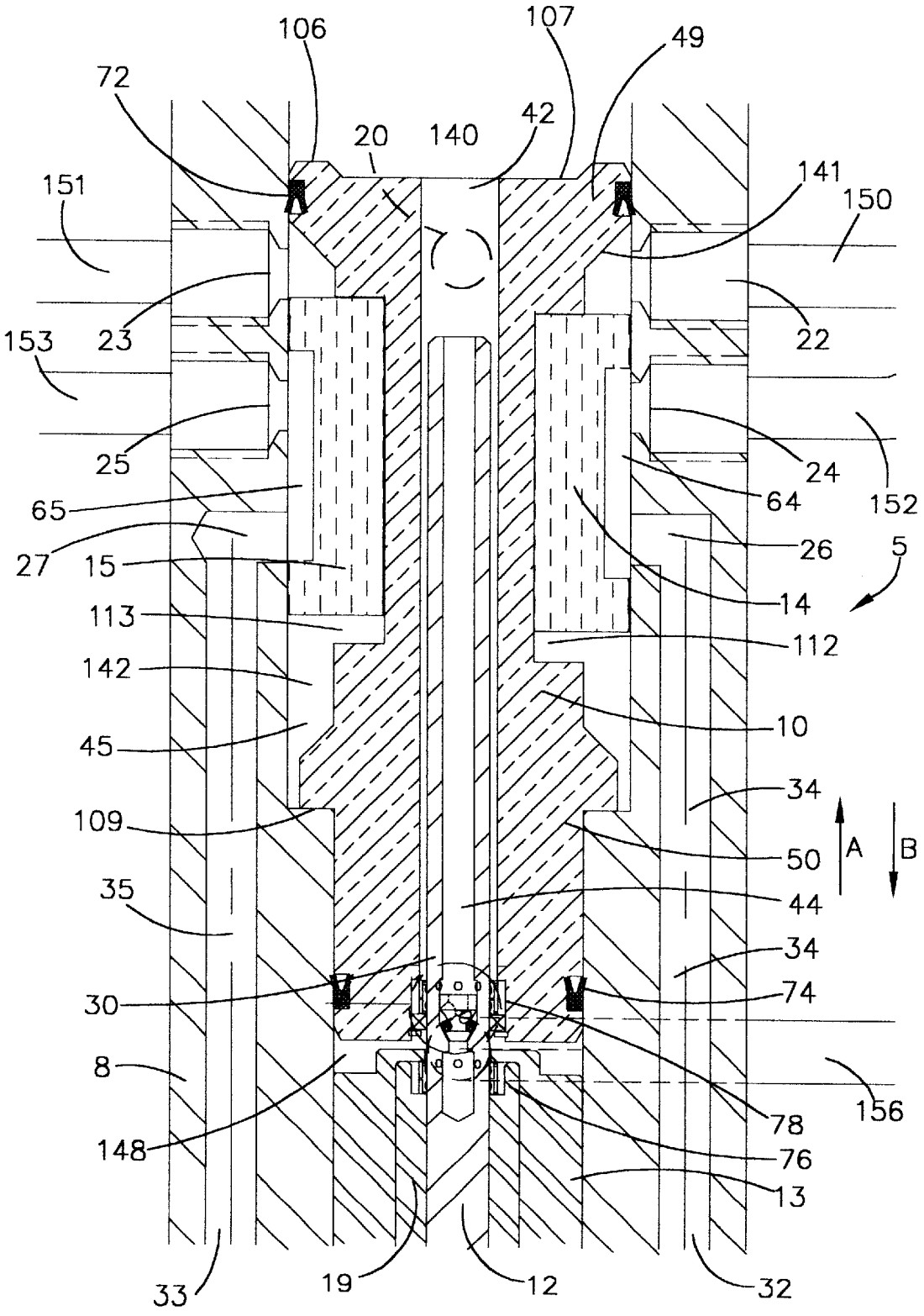
FIG. 1A is an enlarged vertical cross-sectional view of a portion of the present invention as shown in FIG. 1.

Referring now to the drawings, FIGS. 1–4 illustrate a preferred embodiment of the apparatus of the present invention and illustrate an assembled pilot control valve of the present invention. FIG. 1A is included as an enlargement of a portion of the pilot control valve of the present invention as shown in FIG. 1 for clarity purposes. Reference numeral 5 is used to generally designate the pilot control valve of the present invention. As will be appreciated from FIGS. 1–4, pilot control valve 5 is coupled to a piston assembly 9. The piston assembly 9 can be attached to a reciprocating device 250 such as a single or double-acting liquid pump utilizing a reciprocating plunger, diaphragm, or bellows. The pilot control valve 5 drives a piston 18 using compressible, non-compressible, or dual-phase pressurized control fluid. The control fluid is typically liquid or gas or some combination of both and will depend on the nature of the pumping application. The control fluid is generally maintained at a pressure ranging anywhere from 20 psi to 1,500 psi, but higher or lower pressures are still within the scope of the invention. As further described below, the pilot control valve 5 achieves a continuous and consistent pumping rate for the reciprocating device 250 using only pneumatic valve control.

The pilot control valve 5 includes a valve body 8 having a central bore 45 extending longitudinally through the valve body 8. The valve body 8 has an upper cylindrical portion having a slightly greater diameter than a lower cylindrical portion. A port 20 intermediate the ends of the valve body 8 and positioned in the wall of the upper cylindrical portion provides pressurized control fluid to the valve body 8. Also, intermediate the ends of the valve body 8 are provided ports 22, 24 and 26 along one wall of the upper cylindrical portion and ports 23, 25 and 27 along an opposite wall of the upper cylindrical portion. On the opposing walls of the upper cylindrical portion, port 22 is aligned across from port 23, port 24 is aligned across from port 25 and port 26 is aligned across from port 27. As further described below, ports 20, 22, 23, 24, 25, 26 and 27 provide communication between the central bore 45 and, under selected operating conditions, either a source of supply of the control fluid, an upper piston chamber 144 of the piston assembly 9, a lower piston chamber 146 of the piston assembly 9, or the atmosphere to exhaust the control fluid.

In the lower cylindrical portion of the valve body 8, there is provided a port 32 disposed in the lower end portion of the valve body 8 and a longitudinal passageway 34 which extends parallel to the central bore 45 from port 32 to port 26. Similarly, in the lower end portion of the valve body 8 opposite port 32 is provided a port 33. Port 33 connects to port 27 through a passageway 35 which extends parallel to the central bore 45. Both longitudinal passageway 34 and longitudinal passageway 35 are formed integrally within the walls of the valve body 8. The longitudinal passageway 34 provides through ports 26 and 32 communication between the central bore 45 and the upper piston chamber 144 of the piston assembly 9, and the longitudinal passageway 35 provides through ports 27 and 33 communication between central bore 45 and the upper piston chamber 144 of the piston assembly 9.

As shown in FIGS. 1–4, valve body 8 having central bore 45 slideably receives a valve member 10. Valve member 10 includes a cylindrical portion to slideably engage the interior surface of the lower cylindrical portion of valve body 8. Valve member 10 further includes an upper flared portion 49 to slideably engage the interior surface of the upper cylindrical portion of the valve body 8. The flared portion 49 of the valve member 10 defines a first pressure receiving surface 141 and an annular chamber 142 between the inner surface of the valve body 8 and the outer surface of the valve member 10. Valve member 10 further includes a lower flared portion 50. Lower flared portion 50 has a smaller diameter than upper flared portion 49 and does not engage the interior surface of the upper cylindrical portion of the valve body 8 as does the upper flared portion 49. The lower flared portion 50, however, does have a diameter greater than the lower cylindrical portion of valve body 8 and upon downward movement of valve member 10 will engage the lower cylindrical portion at surface 109.

In a portion of the outer surface of valve member 10 intermediate the upper flared portion 49 and the lower flared portion 50 is provided a first slot 112 shaped for receiving and slideably engaging a first slide valve 14 to the valve member 10. As shown, first slide valve 14 is in the form of a "d-slide" valve defining an inner slot 64. In one embodiment, first slide valve 14 is of a length slightly less than the length of the first slot 112. This permits the first slide valve 14 to slide within the first slot 112 relative to the valve member 10 under selected conditions as further described below. Alternatively, due to the requirements of some applications as discussed below, the first slide valve 14 may be sized to fit the precise length of the first slot 112. Under these conditions, first slide valve 14 will slide integrally with valve member 10 and not relative to valve member 10. Furthermore, as the first slide valve 14 slides within the first slot 112, inner slot 64 is selectively positioned to straddle and "cover" or "uncover" ports 22, 24 and 26.

In a portion of the outer surface of the valve member 10 opposite to first slot 112 is a second slot 113. The second slot 113 is shaped for receiving and slideby engaging a second slide valve 15 to the valve member 10. Similar to first slide valve 14, second slide valve 15 is in the form of a "d-slide" valve and defines an inner slot 65. In one embodiment, second slide valve 15 is of a length slightly less than the length of the second slot 113, and this permits second slide valve 15 to slide within the second slot 112 relative to the valve member 10. Alternatively, similar to the first slide valve 14, the second slide valve 15 may be sized to fit the precise length of the second slot 113. Under these conditions, second slide valve 15 will slide integrally with valve member 10 and not relative to valve member 10. Finally, as the second slide valve 15 slides within the second slot 113, inner slot 65 is selectively positioned to straddle and "cover" or "uncover" ports 23, 25 and 27.

The determination of whether first slide valve 14 and second slide valve 15 should be fixed integrally with valve member 10 or slideable with respect to valve member 10 depends on the application. For example, for applications using a liquid and gas combination as the control fluid and operating under high pressure, first slide valve 14 and second slide valve 15 should move relative to valve member 10 for best performance. Thus, first slot 112 should be slightly larger than first slide valve 14 and second slot 113 should be slightly larger than second slide valve 15. Alternatively, for applications using only gas as the control fluid and operating at high pressure, the first slide valve 14 and the second slide valve 15 should be fixed relative to the valve member 10 by being sized to precisely fit first slot 112 and second slot 113, respectively.

As can be appreciated from FIGS. 1–4, first slot 112 is positioned at a slight offset from second slot 113 in the valve member 10. This offset typically ranges from 0 (no offset) to ⅛ of an inch, and in one embodiment is 1/16 of an inch. It can be appreciated, however, that larger offsets could be used and still be within the scope of the invention. As further discussed below, the existence of the offset provides that movement of first slide valve 14 is initiated prior to movement of the second slide valve 15 and this helps to prevent stalling of the valve member 10. As valve member 10 moves upward, the lower edge of first slide valve 14 is engaged by valve member 10 just prior to the lower edge of second slide valve 15 being engaged by valve member 10.

Although the pilot control valve of the present invention has been described having two slide valves and two slots for receiving such slide valves, it can be appreciated that additional slide valves and slots could be added to the valve member without departing from the scope of this invention. Additional slide valves and slots could be added due to the cylindrical nature of the valve member and positioned at opposing points in the surface of the valve member.

At the upper end of the outer surface of valve member 10 there is provided a seal 72 and at the lower end of the outer surface of valve member 10 there is provided a seal 74. Seals 72 and 74 each include an annular cup seal set in a groove formed in the outer surface of valve member 10 to engage the inner surface of valve body 8 and preclude the escape of control fluid from annular chamber 142 as further described below.

Valve member 10 is further provided with a central longitudinal bore 42 which extends throughout valve member 10. Central longitudinal bore 42 is sized to receive a piston rod 12 extending from the piston assembly 9. Valve member 10 is further provided with a seal 78 formed in the inner surface of valve member 10 at its lower end to engage the outer surface of the piston rod 12 and to preclude the escape of control fluid from central longitudinal bore 42 into lower chamber 148 as further described below.

Valve body 8 is provided with a top cap 6 sealable connected to the upper end of the valve body 8. Valve body 8 is further provided at its lower end with a sleeve member 13 having an upper sleeve surface 115. Sleeve member 13 sealingly engages the inner surface of the lower portion of the valve body 8 and defines a lower chamber 148 between the upper sleeve surface 115 and a lower end surface 116 of the valve member 10. Sleeve member 13 further includes an inner sleeve coupling member 19 for fitting into the top flange 16 of the piston assembly 9 and slideably engaging the piston rod 12. The inner sleeve coupling member 19 stabilizes the coupling between the valve body 8 and the piston assembly 9. Also, sleeve member 13 includes a seal 76 set in the inner surface of the inner sleeve coupling member 19 at its upper end to preclude the escape of control fluid from the lower chamber 148.

A piston 18 having an upper surface 110 and a lower surface 108 is positioned within a piston housing 11 of the piston assembly 9 to define the upper piston chamber 144 and the lower piston chamber 146. Piston 18 is provided at its edge with a crown seal 84 to preclude communication of control fluid between upper piston chamber 144 and lower piston chamber 146. The piston 18 has a piston rod 12 rigidly attached which is aligned with the central longitudinal bore 42 of valve member 10. The piston rod 12 extends into central longitudinal bore 42 through a port 62 in top flange 16. The piston rod 12 further includes a central rod bore 44 having a poppet 28 at its lower end which provides communication between central rod bore 44 and, under selected operating conditions as further described below, either lower chamber 148 or upper piston chamber 144. The operating functions and design of a "poppet" are generally known to those of ordinary skill in the art. Furthermore, depending on the pressure of the control fluid and other operating conditions, a "rod ball" valve device, a vent opening or other similar valve device would be an acceptable substitution for the "poppet" as known by those of ordinary skill in the art.

Figure 2:
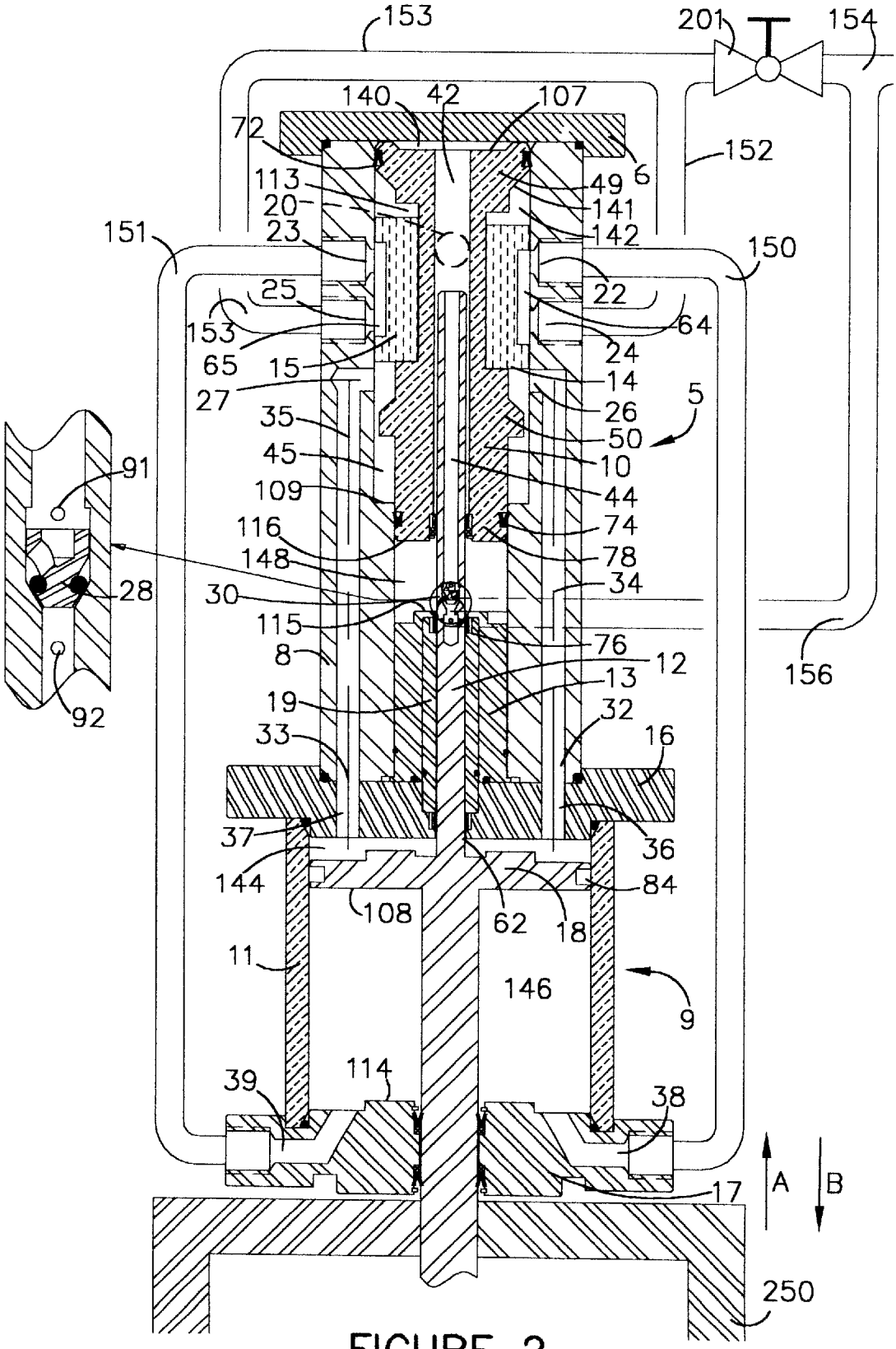
FIG. 2 is a vertical cross-sectional view of the present invention with the valve member of the present invention in its second position, the piston in the second position, and the poppet in its first position.
Figure 3:
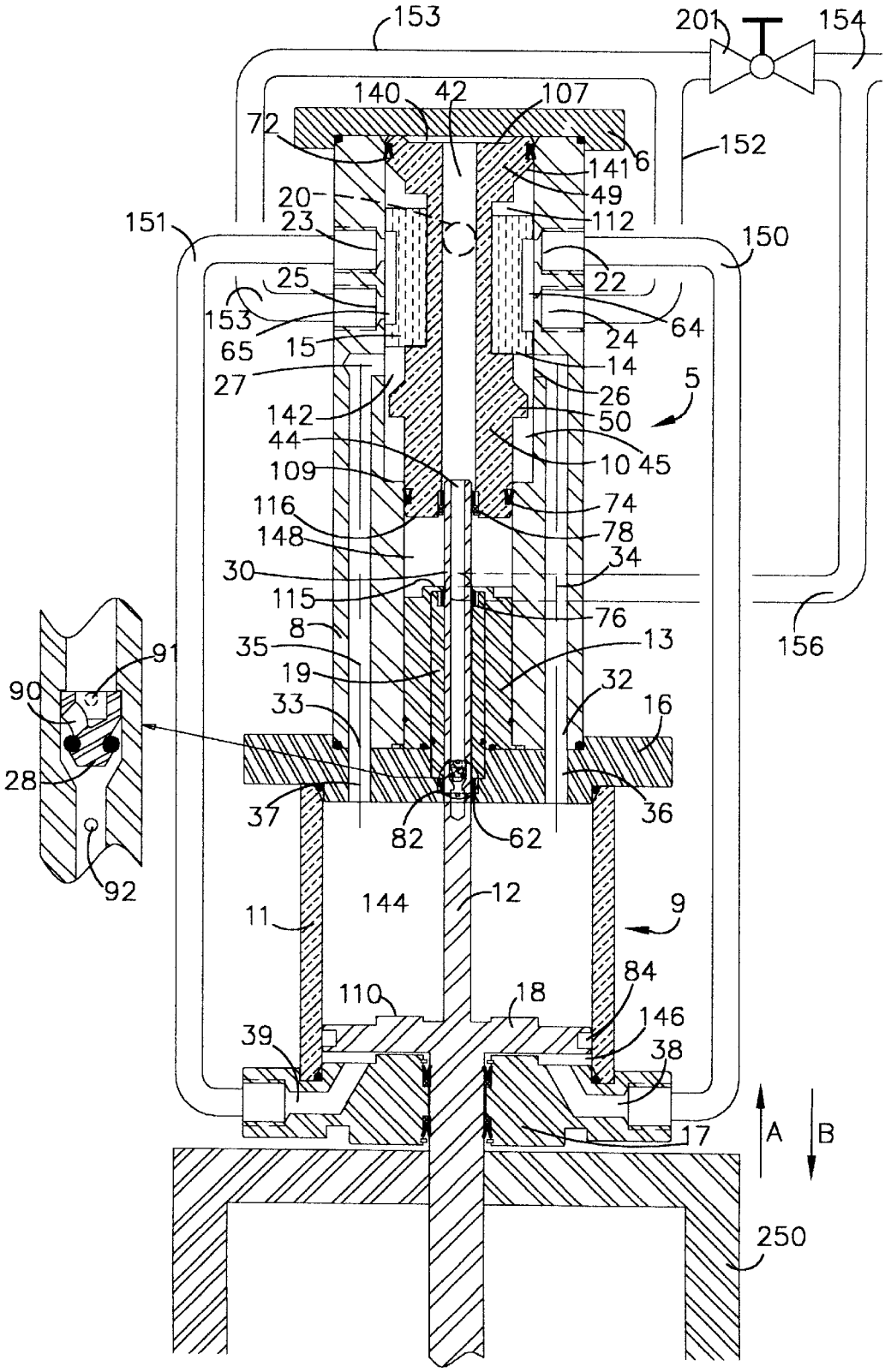
FIG. 3 is a vertical cross-sectional view of the present invention with the valve member of the present invention in its second position, the piston in the first position, and the poppet in its second position.
Figure 4:
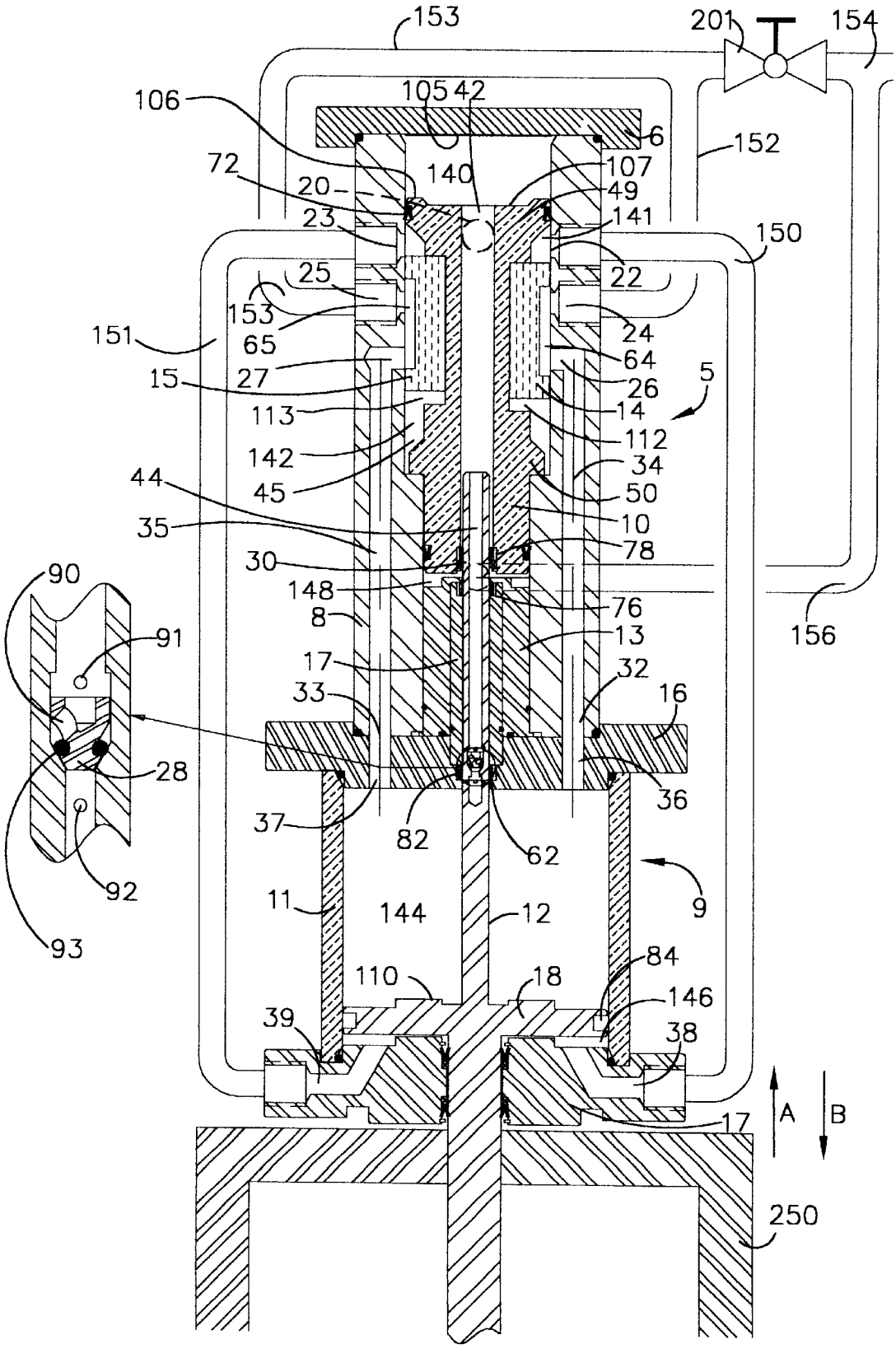
FIG. 4 is a vertical cross-sectional view of the present invention with the valve member of the present invention in its first position, the piston in its first position, and the poppet in its first position.

Immediately above the poppet 28 bored in the piston rod wall is positioned an upper poppet vent 91 and immediately below the poppet 28 also bored through the piston rod wall is positioned a lower poppet vent 92. Under selected operating conditions as further described below, the upper poppet vent 91 and the lower poppet vent 92 act to "open" and "close" the poppet 28 to cause the poppet 28 to either allow communication of control fluid or block communication of control fluid through a poppet angled vent 90 between the upper and lower portions of the central rod bore 44. As shown in FIGS. 1 and 2, the poppet 28 is in the "closed" or first position. In the closed position, the poppet 28 prevents communication of control fluid from the upper portion of the central rod bore 44 and the lower portion of the central rod bore 44 as seal 93 is pressed against the inner surface of the piston rod 12. As shown in FIGS. 3 and 4, the poppet 28 is in the "open" or second position. In the open position, the poppet 28 allows communication of control fluid from the upper portion of the central rod bore 44 and the lower portion of the central rod bore 44 as seal 93 is backed away from the inner surface of the piston rod 12.

Figure 5:
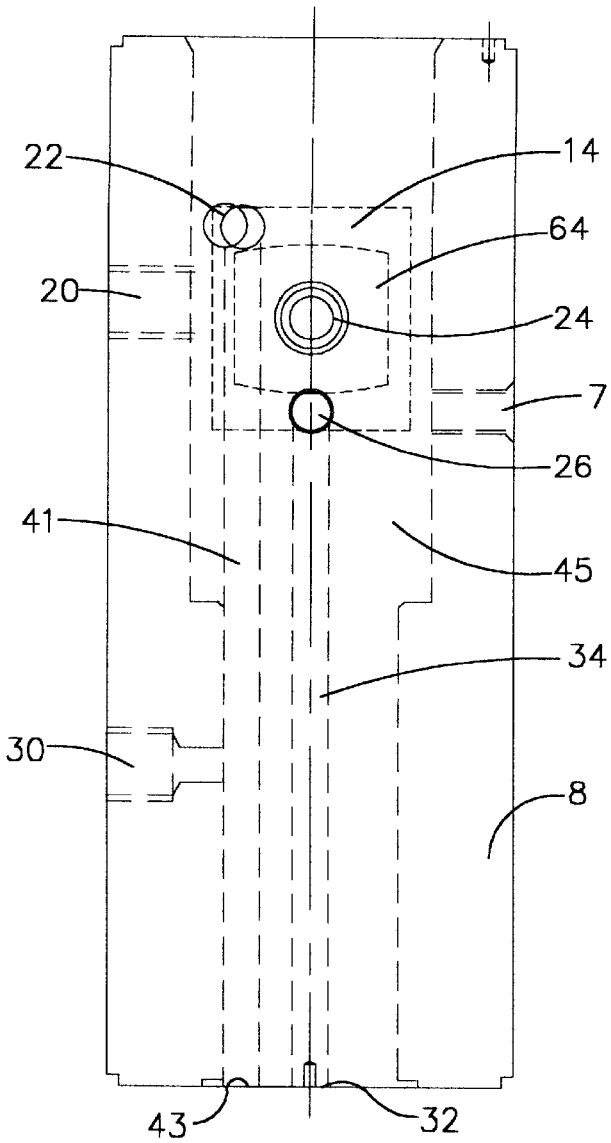
FIG. 5 is a rotated vertical cross-sectional view of an alternative embodiment of the present invention showing both sets of pressurized fluid conduits positioned within the valve body.
Figure 6:
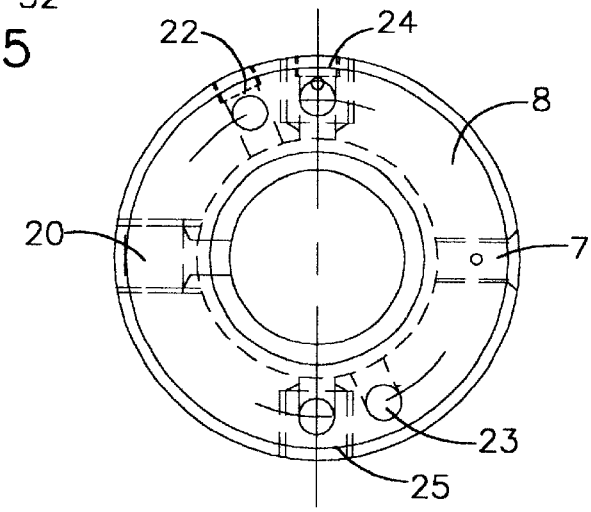
FIG. 6 is a top cross-sectional view of an alternative embodiment of the present invention showing the alignment of the control ports.

FIGS. 5 and 6 show an alternative embodiment of the present invention having both pairs of pressurized fluid passageways formed integrally within the walls of the valve body 8. This embodiment is particularly useful for applications having space limitations where using lines 150 and 151 external to the valve body 8 is impractical.

Referring more specifically to FIGS. 5 and 6, it can be appreciated that the valve body 8 in FIG. 5 has been rotated 90° from the perspective shown in FIGS. 1–4. Longitudinal passageway 34 is shown extending within valve body 8 parallel to the central bore 45 from port 26 to port 32, and port 24 is positioned above port 26. First slide valve 14 is shown in an intermediate position with inner slot 64 communicating with port 24 and ports 22 and 26 covered. Also shown is pressurized control fluid port 20, exhaust port 30 and an alignment screw port 7 for placement of an alignment screw for maintaining the alignment of valve body 8 during operation.

Unlike the embodiment in FIGS. 1–4, port 22 is positioned at a slight offset in alignment from ports 24 and 26, but port 22 is still positioned relative to first slide valve 14 to be selectively "covered" and "uncovered" as first slide valve 14 slides within first slot 112. A longitudinal passageway 41 extends below port 22 within the valve body 8 parallel to the central bore 45 and longitudinal passageway 34. Because port 22 is offset from port 26 and because of the cylindrical nature of valve body 8, longitudinal passageway 41 does not cross or interfere with longitudinal passageway 34. Longitudinal passageway 41 provides fluid communication from port 22 to a port 43 disposed in the lower end portion of the valve body 8. FIG. 6 shows that ports 24 and 26 are positioned across the valve body 8 from ports 25 and 27 and that port 22 is positioned across from port 23.

In operation, longitudinal passageway 41 functions to communicate control fluid to the lower piston chamber 146 similar to line 150 in FIGS. 1–4 as discussed below. It can be appreciated by one of ordinary skill in the art that the piston housing 11 could be configured with a passageway or line to direct the control fluid delivered through port 43 to the lower piston chamber 146. It can further be appreciated by one of ordinary skill in the art that FIG. 5 shows one side of valve body 8 and a longitudinal passageway reciprocal to longitudinal passageway 41 would be included on the opposite side of the valve body 8 to provide communication of control fluid from port 23 and similar to line 151 to deliver control fluid to the lower piston chamber 146.

The operation of the present invention will now be described with continued reference to FIGS. 1–4. As further described below, valve member 10 is slideably shiftable in central bore 45 between a first position and a second position by means of pressure applied by control fluid supplied to valve body 8 through port 20. The movement of valve member 10 between a first position and a second position further controls the communication of control fluid to either the upper surface 110 or the lower surface 108 of piston 18 to drive the piston 18 between a first position and a second position. In this manner, reciprocating device 250 achieves a consistent pumping rate.

Although FIGS. 1–4 show the pilot control valve 5 and the piston assembly 9 configured to drive a single reciprocating device 250, it can be appreciated by one of ordinary skill in the art that multiple reciprocating devices 250 could be driven by the present invention in additional embodiments. For example, additional reciprocating devices 250 could be cascaded below the piston assembly 9 with each drawing its pumping motion form the movement of piston 18 and piston rod 12. Each reciprocating device 250 would be mechanically coupled in some fashion to piston rod 12. Furthermore, a reciprocating device 250 could be positioned above pilot control valve 5 and driven in accordance with the present invention by extending piston rod 12 up through a hole in the top cap 6. The pumping motion of such reciprocating device 250 would be achieved through a mechanical coupling to piston rod 12 and such motion would be synchronized with the motion of the reciprocating devices 250 positioned below the pilot control valve 5. For clarity purposes, the present invention is described below with reference to a single reciprocating device 250.

FIG. 1 shows valve member 10 in its first or "downstroke" position, piston 18 in its second or "upstroke" position and poppet 28 in its first or "closed" position. FIG. 2 shows valve member 10 moved to its second or "upstroke" position, piston 18 remaining in its second or "upstroke" position and poppet 28 in its first or "closed" position. FIG. 3 shows valve member 10 remaining in its second or "upstroke" position, piston 18 moved to its first or "downstroke" position and poppet 28 in its second or "open" position. Finally, FIG. 4 shows valve member 10 moved to its first of "downstroke" position, piston 18 in its first or "downstroke" position and poppet 28 in its first or "closed" position.

With valve member 10 in its first position as shown in FIG. 1, control fluid supplied to the valve body 8 through port 20 communicates pressurized control fluid to annular chamber 142. Within annular chamber 142, the control fluid is isolated at the upper end of valve member 10 by seal 72 and at the lower end of valve member 10 by seal 74. The lower flared portion 50 of the valve member 10 engages a surface 109 formed by the difference in the diameter between the upper cylindrical portion and the lower cylindrical portion of the valve body 8 and prevents the further movement of valve member 10 downward in the direction of Arrow B.

When valve member 10 is in its first position, first slide valve 14 covers ports 24 and 26 and allows port 22 to communicate with annular chamber 142. Similarly, second slide valve 15 covers ports 25 and 27 and allows port 23 to communicate with annular chamber 142. Thus, control fluid is forced through port 22 and directed through line 150 to a port 38 in a lower flange 17 of piston assembly 9 thereby communicating control fluid into lower piston chamber 146 to exert upward force on the lower surface 108 of piston 18. Similarly, control fluid is forced through port 23 and directed through line 151 to a port 39 in the lower flange 17 thereby communicating control fluid into lower piston chamber 146 to exert upward force on the lower surface 108 of piston 18.

With first slide valve 14 in its first position, ports 24 and 26 communicate via inner slot 64. With second slide valve 15 in this position, ports 25 and 27 communicate via inner slot 65. Upper piston chamber 144 vents to low pressure via port 36, port 32, longitudinal passageway 34, port 26, inner slot 64, port 24, line 152, an adjustable backpressure valve 201 and line 154. A dual pressure release is achieved as upper piston chamber 144 also vents to lower pressure via port 37, port 33, longitudinal passageway 35, port 27, inner slot 65, port 25, line 153, adjustable back pressure valve 201 and line 154. By the dual action of the pressurized control fluid entering lower piston chamber 146 through ports 38 and 39, piston 18 is driven in the direction of Arrow A to its second position as shown in FIG. 1. Because control fluid is communicated through multiple passageways to lower piston chamber 146, a greater volume of control fluid is applied to the piston 18 than would be applied if only a single passageway was used to communicate such control fluid. Because the control fluid can more quickly fill the lower piston chamber 146, the piston 18 accelerates upward at an increased rate.

As piston 18 and thereby piston rod 12 reach the second position, the upper poppet vent 91 crosses through seal 76. At this point, the upper poppet vent 91 communicates with the pressurized control fluid in recess chamber 140, central longitudinal bore 42, and central rod bore 44, causing the poppet 28 to move to its first position. With poppet 28 in its first position, recess chamber 140 is able to vent to low pressure through central longitudinal bore 42, central rod bore 44, upper poppet vent 91, lower chamber 148, port 30 and line 156 vented to low pressure at line 154. A representative low pressure is atmospheric pressure or any pressure which is low enough such that the differential pressure between the supply pressure and the exhaust pressure is sufficient to overcome the frictional forces of the seals and the intertia of the pumping mechanism.

The venting of recess chamber 140 creates a pressure differential between recess chamber 140 and annular chamber 142 across seal 72. This results in a force generated against the first pressure receiving surface 141 of valve member 10 to move valve member 10 upward in the direction of Arrow A toward its second position as shown in FIG. 2. Valve member 10 continues to move in the direction of Arrow A until an upper end surface 106 of valve member 10 engages a lower cap surface 105 of top cap 6. A second pressure receiving surface 107 of valve member 10 defines the recess chamber 140 between the valve member 10 and the lower cap surface 105 of top cap 6.

When valve member 10 moves to its second position as shown in FIG. 2, first slide valve 14 moves upward to cover ports 22 and 24 and uncover port 26. Similarly, second slide valve 15 moves upward to cover ports 23 and 25 and uncover port 27. With first slide valve 14 in this position, ports 22 and 24 communicate via inner slot 64. With second slide valve 15 in this position, ports 23 and 25 communicate via inner slot 65. Lower piston chamber 146, which was pressurized with the valve member 10 in its first position, vents to low pressure via port 38, line 150, port 22, inner slot 64, port 24, line 152, an adjustable backpressure valve 201 and line 154. A dual pressure release is achieved as lower piston chamber 146 also vents to lower pressure via port 39, line 151, port 23, inner slot 65, port 25, line 153, adjustable back pressure valve 201 and line 154. With ports 26 and 27 now uncovered, pressurized control fluid in annular chamber 142 communicates with upper piston chamber 144 of piston 18 through port 26, longitudinal passageway 34, port 32 and port 36 in top flange 16 and through port 27, longitudinal passageway 35, port 33 and port 37 in top flange 16.

The differential pressure between the control fluid in upper piston chamber 144 and lower piston chamber 146 exerts a downward force on upper surface 110 of piston 18 forcing piston 18 downward in the direction of Arrow B to its first position as shown in FIG. 3. Piston 18 continues in its downward motion until lower surface 108 of piston 18 engages an upper surface 114 of lower flange 17. The rate of downward motion of piston 18 is controlled by the adjustment of the backpressure valve 201 to vary the rate that the control fluid acting on the lower surface 108 of piston 18 is depressurized and vented. Because control fluid is being delivered to the upper surface 110 of piston 18 through multiple passageways, a greater volume of control fluid is applied to the piston 18 than would be applied if only a single passageway was used to communicate such control fluid. This results in a greater acceleration rate of the piston 18.

As piston 18 moves downward in the direction of Arrow B, lower poppet vent 92 passes through seal 82 positioned in the inner surface of bore 62. Seal 82 precludes communication between upper piston chamber 144 and central bore 45. Lower chamber 148 is continuously vented to low pressure via port 30, line 156 and line 154. Seal 74 prevents pressurized control fluid in annular chamber 142 from communicating with lower chamber 148.

As lower poppet vent 92 passes through seal 82, it communicates with upper piston chamber 144. Upper piston chamber 144 contains pressurized control fluid via ports 26 and 27, longitudinal passageways 34 and 35, ports 32 and 33 and ports 36 and 37 in top flange 16. Pressurized control fluid from upper piston chamber 144 pushes poppet 28 to its second position and the control fluid enters central longitudinal bore 42 via lower poppet vent 92, poppet angled vent 90, and central rod bore 44 to act on the second pressure receiving surface 107 of valve member 10. In this manner, the control fluid in recess chamber 140 achieves a pressure equal to the control fluid in annular chamber 142. Because the second pressure receiving surface 107 of valve member 10 is of a greater surface area than the first pressure receiving surface 141, a downward force is generated forcing valve member 10 to move downward from its second position to its first position in the direction of Arrow B as shown in FIG. 4.

The movement of valve member 10 from its second position to its first position causes slide valve 14 to move to cover ports 24 and 26 and allows port 22 to communicate with annular chamber 142. Similarly, the movement of valve member 10 to its first position causes slide valve 15 to move to cover ports 25 and 27 and allows port 23 to communicate with annual chamber 142. Valve member 10 is forced downward until the lower flared portion 50 of valve member 10 engages surface 109 of valve body 8.

With valve member 10 in its first position, upper piston chamber 144 vents to low pressure through port 36, port 32, longitudinal passageway 34, port 26, inner slot 64, port 24, line 152, backpressure valve 201 and line 154. Similarly, upper piston chamber 144 vents to low pressure through port 37, port 33, longitudinal passageway 35, port 27, inner slot 65, port 25, line 153, backpressure valve 201 and line 154. As the upper piston chamber 144 depressurizes, but prior to commencement of movement of the piston 18 in the direction of Arrow A, the lower poppet vent 92 which is still positioned below seal 82 communicates briefly with low pressure. The upper poppet vent 91 which is above seal 82 continues to communicate with the pressurized control fluid in recess chamber 140, central longitudinal bore 42 and central rod bore 44. This pressure differential causes the poppet 28 to move to its first position. In the first and "closed" position, seal 93 precludes communication of control fluid through poppet angled vent 90, thus preventing premature movement of valve member 10 in the direction of Arrow A before piston 18 can move upward and lower poppet vent 92 can no longer communicate with upper piston chamber 144.

Pressurized control fluid in annular chamber 142 is communicated to lower piston chamber 146 through port 22, line 150 and port 38 in lower flange 17 and through port 23, line 151, and port 39 in lower flange 17 to force piston 18 to its second position as shown in FIG. 1. The cycle is then repeated again and again. The rate of upward motion of piston 18 is controlled by the adjustment of the backpressure valve 201 to vary the rate that the control fluid acting on the upper surface 110 of piston 18 is depressurized and vented. As discussed above, similar to the pressurization of the lower piston chamber 146, a greater volume and pressure of control fluid is applied to piston 18 through the multiple passageways than would be applied if only a single passageway was used to communicate control fluid to the piston 18. Because greater pressure is applied to the piston 18, the piston 18 accelerates downward at an increased rate.

In this manner, the pilot control valve 5 of the present invention controls communication of control fluid to the piston 18 using pneumatic valve control, and the reciprocating device 250 coupled to the piston assembly 9 achieves a continuous and consistent pumping rate.

Although a preferred embodiment of the present invention has been described with reference to the foregoing detailed description and the accompanying drawings, it will be understood that the present invention is not limited to the preferred embodiment disclosed but includes modifications and equivalents without departing from the scope of the invention as claimed.

What is claimed as invention is:

1. A pump comprising:

a valve body having an internal bore;

a piston coupled to the valve body having an upper surface and a lower surface, the piston positioned within a piston housing to define an upper piston chamber and a lower piston chamber;

a fluid inlet port in the valve body for communicating pressurized fluid to the valve body;

a first set of pressurized fluid conduits for communicating pressurized fluid from the valve body to the lower piston chamber to act on the lower surface of the piston;

a fluid exhaust conduit for communicating fluid from the valve body to a low pressure source;

a valve member slideable within the internal bore being selectively shiftable between first and second positions, the valve member having first and second pressure receiving surfaces selectively exposed to pressurized fluid from the fluid inlet port, the valve member further engaging a plurality of slide valves shiftable between a first and second position, the valve member in the first position positioning the slide valves in the first position to communicate pressurized fluid from the valve body through the first set of pressurized fluid conduits to the lower piston chamber and depressurize fluid in the upper piston chamber acting on the upper surface of the piston through the fluid exhaust conduit to urge the piston toward its second position;

a poppet responsive to the piston in the second position for depressurizing fluid acting on the second pressure receiving surface of the valve member through the fluid exhaust conduit, the pressurized fluid acting on the first pressure receiving surface of the valve member in response to the depressurization of the fluid acting on the second pressure receiving surface to move, the valve member from the first position to the second position;

a second set of pressurized fluid conduits for communicating pressurized fluid from the valve body to the upper piston chamber to act on the upper surface of the piston;

the valve member in the second position positioning the slide valves in the second position to communicate pressurized fluid from the valve body through the second set of pressurized fluid conduits to the upper piston chamber and depressurize fluid in the lower piston chamber acting on the lower surface of the piston through the fluid exhaust conduit to urge the piston toward its first position; and the poppet responsive to the piston in the first position for communicating pressurized fluid through the valve body to the second pressure receiving surface of the valve member to move the valve member from its second position to its first position.

2. The pump of claim 1 wherein the first pressure receiving surface of the valve member is formed by a flared portion of the valve member slideable within the internal bore of the valve body and communicating with pressurized fluid supplied through the fluid inlet port.

3. The pump of claim 1 wherein the second pressure receiving surface of the valve member has a greater surface area than the first pressure receiving surface of the valve member to generate a force when the valve member is in its second position that moves the valve member to its first position.

4. The pump of claim 1 wherein the valve member includes a central longitudinal bore, the central longitudinal bore aligned to receive a rod rigidly attached to the piston and the rod having a central rod bore in fluid communication with the central longitudinal bore of the valve member.

5. The pump of claim 4 wherein the poppet is in a closed position when the valve member moves to the second position, the poppet depressurizing fluid in the central longitudinal bore of the valve member acting on the second pressure receiving surface of the valve member.

6. The pump of claim 5 wherein the poppet is moved to its closed position when pressurized fluid is applied to an upper poppet vent and low pressure is applied to a lower poppet vent.

7. The pump of claim 4 wherein the poppet is moved to an open position when the piston is moved to its first position to communicate pressurized fluid from the upper piston chamber through the central longitudinal bore of the valve member to act on the second pressure receiving surface of the valve member to urge the valve member from its second position to its first position.

8. The pump of claim 7 wherein the poppet is moved to its open position when pressurized fluid is applied to a lower poppet vent and low pressure is applied to an upper poppet vent.

9. The pump of claim 1 wherein the plurality of slide valves are offset with respect to each other to prevent stalling of the valve member.

10. The pump of claim 1 wherein each slide valve is of a length less than the length of a slot in the valve member shaped for receiving the slide valve, each slide valve able to slide relative to the valve member.

11. The pump of claim 1 wherein each slide valve tightly fits a slot in the valve member for receiving the slide valve, each slide valve sliding integrally with the valve member.

12. The pump of claim 1 wherein the first and second set of pressurized fluid conduits are formed integrally within the valve body.

13. The pump of claim 12 wherein a first set of control ports are offset along the circumference of the valve body relative to a second set of control ports, the offset allowing the first set of pressurized fluid conduits to communicate pressurized fluid from the first set of control ports through the valve body to the lower piston chamber without crossing the second set of pressurized fluid conduits.

14. The pump of claim 1 further comprising a reciprocating device coupled to the piston.

15. The pump of claim 14 wherein the reciprocating device achieves a pumping rate responsive to a backpressure valve coupled to the valve body that adjusts the depressurizing rate of the fluid acting on the upper and lower surfaces of the piston.

16. The pump of claim 1 further comprising a plurality of reciprocating devices coupled to the piston.

17. A pilot control valve coupled to a piston and reciprocating device comprising:

a valve body having an internal bore;

means for communicating pressurized fluid to the valve body;

means for communicating pressurized fluid from the valve body to a lower piston chamber of the piston to act on the lower surface of the piston;

means for communicating fluid from the valve body to a low pressure source;

means for sliding within the internal bore between first and second positions, the means for sliding having first and second pressure receiving surfaces selectively exposed to pressurized fluid, the means for sliding further engaging a plurality of slide valves shiftable between a first and second position, the means for sliding in the first position positioning the slide valves in the first position to communicate pressurized fluid through the means for communicating to the lower piston chamber to move the piston from a first position to a second position;

means for responding to the piston in the second position to depressurize the fluid acting on the second pressure receiving surface through the means for communicating and to permit pressurized fluid to act on the first pressure receiving surface of the valve member to move the means for sliding from the first position to the second position;

means for communicating pressurized fluid from the valve body to an upper piston chamber of the piston to act on the upper surface of the piston;

the means for sliding in the second position positioning the slide valves in the second position to communicate fluid to the upper piston chamber through the means for communicating to move the piston from the second position to the first position; and means for responding to the piston in the first position to communicate pressurized fluid through the valve body to the second pressure receiving surface of the means for sliding to move the means for sliding from its second position to its first position.

18. The pilot control valve of claim 17 wherein the means for sliding includes a central longitudinal bore, the central longitudinal bore aligned to receive a rod rigidly attached to the piston and the rod having a central rod bore in fluid communication with the central longitudinal bore of the means for sliding.

19. The pilot control valve of claim 17 wherein the means for responding comprises a poppet.

20. The pilot control valve of claim 17 wherein the means for responding comprises a vent.

21. The pilot control valve of claim 17 wherein the means for responding comprises a rod ball valve.

22. The pilot control valve of claim 17 wherein the slide valves are offset with respect to each other.

23. The pilot control valve of claim 17 wherein each slide valve is smaller than the slot in the means for sliding shaped for receiving the slide valve, each slide valve able to slide relative to the means for sliding.

24. The pilot control valve of claim 17 wherein the slide valves are integral to the means for sliding and slide integrally with the means for sliding.

25. The pilot control valve of claim 17 wherein the means for communicating pressurized fluid from the valve body to the lower piston chamber are a set of fluid conduits extending along the outside of the valve body.

26. The pilot control valve of claim 17 wherein the means for communicating pressurized fluid from the valve body to the lower piston chamber are longitudinal passageways formed within the valve body.

27. The pilot control valve of claim 17 wherein the means for communicating pressurized fluid from the valve body to the upper piston chamber are longitudinal passageways formed within the valve body.

28. A method for pumping a reciprocating device comprising:

providing for a valve body having an internal bore;

providing for a fluid inlet port in the valve body for communicating pressurized fluid to the valve body;

providing for a piston coupled to the valve body and the reciprocating device, the piston having an upper surface and a lower surface, the piston positioned within a piston housing to define an upper piston chamber and a lower piston chamber;

providing for a plurality of exhaust ports and conduits for venting fluid to a low pressure source;

providing for a first set of control ports and conduits for communicating pressurized fluid to the upper surface of the piston;

providing for a second set of control ports and conduits for communicating pressurized fluid to the lower surface of the piston;

shifting a valve member within the internal bore between first and second positions, the valve member having first and second pressure receiving surfaces;

shifting a plurality of slide valves engaging the valve member between first and second positions;

with the valve member and the slide valves in the first position, allowing communication of pressurized fluid through the second set of control ports and conduits to the lower surface of the piston and allowing communication of fluid through the exhaust ports and conduits to depressurize fluid acting on the upper surface of the piston to urge the piston toward its second position;

with the piston in the second position, depressurizing fluid acting on the second pressure receiving surface of the valve member through the exhaust ports and conduits and allowing pressurized fluid to act on the first pressure receiving surface of the valve member to move the valve member from the first position to the second position;

with the valve member and the slide valves in the second position, allowing communication of pressurized fluid through the first set of control ports and conduits to the upper surface of the piston and allowing communication of fluid through the exhaust ports and conduits to depressurize fluid acting on the lower surface of the piston to urge the piston toward its first position; and with the piston in the first position, allowing pressurized fluid to act on the second pressure receiving surface of the valve member to move the valve member from its second position to its first position.

29. The method of claim 28 further comprising the step of providing a central longitudinal bore in the valve member, the central longitudinal bore aligned to receive a rod rigidly attached to the piston, the rod having a central rod bore in fluid communication with the central longitudinal bore of the valve member and a poppet positioned in the rod at the end of the central rod bore.

30. The method of claim 29 further comprising the step of closing the poppet in the rod to depressurize fluid in the central longitudinal bore of the valve member acting on the second pressure receiving surface of the valve member.

31. The method of claim 29 further comprising the step of opening the poppet in the rod to communicate pressurized fluid from the upper piston chamber through the central longitudinal bore of the valve member to act on the second pressure receiving surface of the valve member to urge the valve member from its second position to its first position.

32. The method of claim 28 wherein each slide valve is of a length less than the length of a slot in the valve member shaped for receiving the slide valve, each slide valve able to slide relative to the valve member.

33. The method of claim 28 wherein each slide valve tightly fits a slot in the valve member for receiving the slide valve, each slide valve sliding integrally with the valve member.

34. The method of claim 28 further comprising the step of achieving a pumping rate responsive to the adjustment of a backpressure valve coupled to the valve body that controls the depressurizing rate of the fluid acting on the upper and lower surfaces of the piston.

* * * * *